US005631879A

United States Patent [19]

Pequignet

[11] Patent Number: 5,631,879

[45] Date of Patent: May 20, 1997

[54] WRIST WATCH WITH INTERCHANGEABLE STRAP

[75] Inventor: Emile Pequignet, Fournets-Luisans, France

[73] Assignee: Montres Pequignet, France

[21] Appl. No.: 605,149

[22] PCT Filed: Sep. 2, 1994

[86] PCT No.: PCT/FR94/01035

§ 371 Date: Mar. 1, 1996

§ 102(e) Date: Mar. 1, 1996

[87] PCT Pub. No.: WO95/06902

PCT Pub. Date: Mar. 9, 1995

[30] Foreign Application Priority Data

Sep. 3, 1993 [FR] France ..... 93 10539

[51] Int. Cl.[6] ..... A44C 5/00; G04B 37/00

[52] U.S. Cl. ..... 368/282; 368/281; 24/176

[58] Field of Search ..... 368/281, 282; 24/168–179

[56] References Cited

U.S. PATENT DOCUMENTS

| | | | |
|---|---|---|---|
| 1,484,420 | 2/1924 | Suderov | 368/281 |
| 1,760,689 | 5/1930 | Domler | 368/282 |
| 2,189,096 | 2/1940 | Alonge | 368/282 |
| 3,492,809 | 2/1970 | Gisiger-Lusa | 368/282 |
| 4,167,850 | 9/1979 | Schneider | 368/282 |
| 4,964,092 | 10/1990 | Brida | 368/282 |
| 5,065,376 | 11/1991 | Choulat | 368/282 |
| 5,206,841 | 4/1993 | Boucheron | 368/276 |

FOREIGN PATENT DOCUMENTS

| | | |
|---|---|---|
| 504267 | 6/1920 | France . |
| 934435 | 6/1948 | France . |
| 2634359 | 1/1990 | France . |
| 154569 | 8/1932 | Switzerland . |
| 333998 | 12/1958 | Switzerland . |
| 536083 | 4/1973 | Switzerland . |

*Primary Examiner*—Bernard Roskoski

*Attorney, Agent, or Firm*—Kerkam, Stowell, Kondracki & Clarke, P.C.; Edward J. Kondracki

[57] ABSTRACT

A wrist watch with interchangeable strap (10) comprises a supporting element (20) with a body (21) and a strap (10) forming a single unit. The strap includes a central slot (11) designed to be fitted about the body (21). A cover (30) can be folded down over the strap (10) by rotation about a hinge (40) formed in the supporting element (20). The cover (30) and supporting element (20) includes a clasp (51, 52) and a button (60) on the supporting element (20) for opening the cover (30).

22 Claims, 4 Drawing Sheets

WRIST WATCH WITH INTERCHANGEABLE STRAP

FIELD OF THE INVENTION

The present invention relates to a wrist watch with an interchangeable strap.

The invention can be applied to particular advantage in the watch-making industry.

DESCRIPTION OF RELATED ART

Various types of wrist watches with interchangeable straps have been proposed in the past. In particular, there is a known watch whose strap, in two parts, can be mounted and taken off by the flipping over of a tip providing access to an attachment rod, fixedly joined to the watch, along which each of the parts of the strap can slide in either direction. This mode of interchangeability of the strap has, however, the drawback of being delicate and not very practical in its use. This results, in the long term, in wear and tear and in a deterioration of the tips and the attachment rods.

There also is a known wrist watch whose strap, which is a single unit, is provided with a central slot designed to be fitted about a body on the middle supporting element of the watch.

While such a configuration enables speedy and easy changing of the strap, this type of watch has, however, the drawback wherein the strap can easily slip away from the body and get detached from the middle supporting element once it is no longer clasped against the user's wrist.

SUMMARY OF THE INVENTION

Thus, the technical problem to be resolved by the object of the present invention is that of proposing a wrist watch with interchangeable strap, comprising a middle supporting element comprising a body, and a strap, forming a single unit, provided with a central slot designed to be fitted about said body that makes it possible, in all circumstances, to ensure that the strap is held positively to the middle supporting element of the watch, without, furthermore, any detrimental effect on the general aesthetic quality of the watch.

The solution to the technical problem raised consists, according to the present invention, in the fact that said wrist watch comprises a cover that can be folded down over the strap by rotation about a hinge made on the middle supporting element, said cover and said middle supporting element bearing clasp means and means for opening the cover on the middle supporting element.

In order to improve the holding of the strap to the watch, it is also provided according to the invention that the body will be surmounted by a gouged feature, said central slot of the strap being capable of being fitted about said body by flexible deformation at the passage of said gouged feature, and inversely.

Thus, the bracelet is held in the middle supporting element of the watch by the gouged feature which prevents any involuntary motion withdrawing the strap. However, a relatively slight force is sufficient to engage or disengage the strap when there is encountered the resistance set up by the gouged feature whose size is slightly greater than that of the slot of the strap. This method of interchangeability is therefore very simple to use and does not require any complex mechanical part. This ensures its reliability. This reliability is further increased owing to the fact that, in order to limit the wear and tear undergone by the slot during the passage of the gouged feature, the invention provides that the slot will made through a central stiffening web prepared in said strap. In particular, said central stiffening web is made of Kevlar (registered mark).

It will be noted that the design of the wrist watch that is an object of the invention is such that it complete integrates the strap into the aesthetics of the watch which, apart from its nominal function, becomes an essential element of decoration that warrants its interchangeability.

In one particular embodiment of the invention, the clasp means are formed by a notch made in the cover, working together with a catch-spring positioned on the middle supporting element, while said opening means are formed by a button of said catch-spring. Advantageously, said button is integrated with a ring of the watch winding mechanism.

In this way, the clasping of the cover is done by simple pressure with action by any other element, in particular a button. The opening of the cover is controlled by the button integrated with the winding mechanism. It is necessary to emphasize the particularly discreet positioning of the button whose integration with the winding mechanism renders an additional element totally inconspicuous whereas this element, if placed elsewhere, would have adversely affected the aesthetic quality of the watch.

BRIEF DESCRIPTION OF THE DRAWINGS

The following description, made with reference to the appended drawings which are given as nonrestrictive examples, will provide for a clear understanding of the content of the invention and the way in which the invention can be achieved.

DESCRIPTION OF THE PREFERRED EMBODIMENTS

Figure 1:
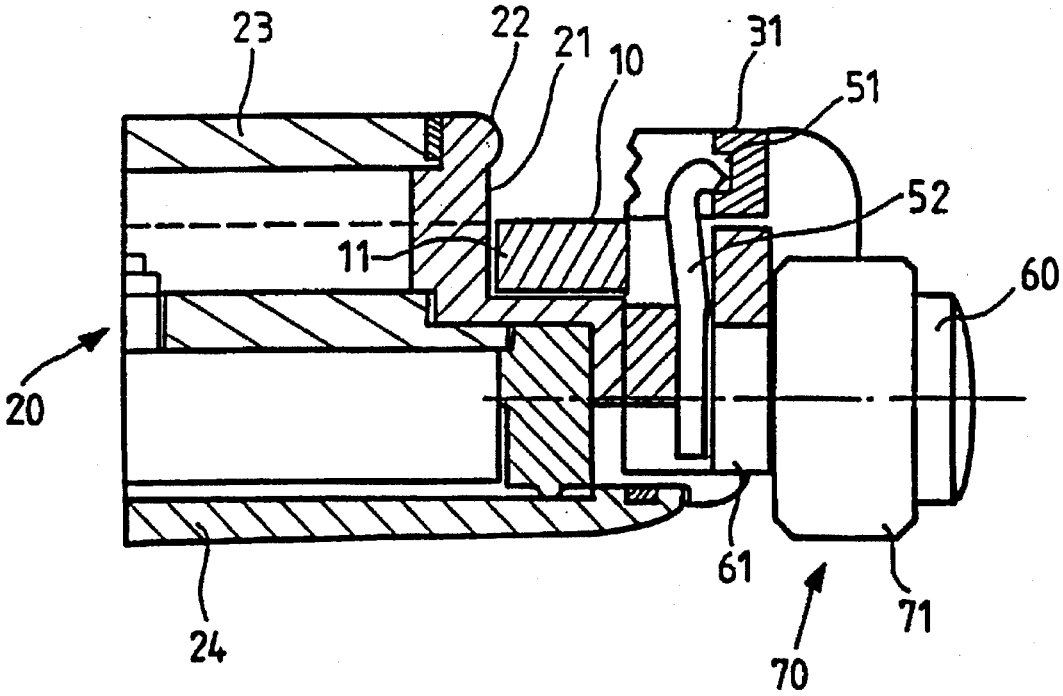
FIG. 1 is a half view, from the side, of a section of a wrist watch according to the invention.
Figure 5:
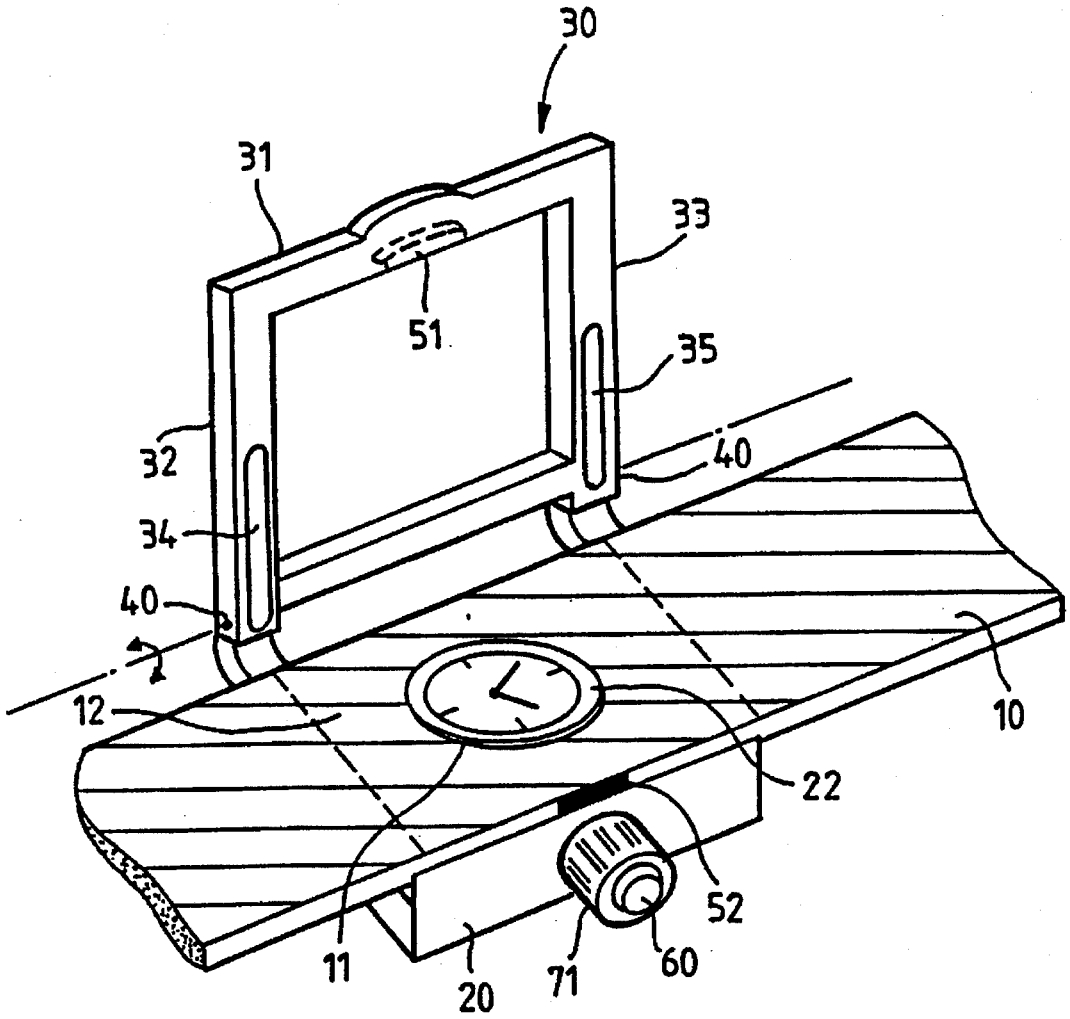
FIG. 5 is a schematic view in perspective of the wrist watch of FIG. 2*a*, with the cover open.

FIG. 1 shows a half sectional view of a wrist watch with interchangeable strap 10, comprising a middle supporting element 20 comprising a structure formed by a body 21, cylindrical for example, surmounted by a circular gouged feature 22 having a diameter substantially greater than that of the body 21. The wrist watch of FIG. 1 also has a strap 10, forming a single unit, that can also been seen in FIGS. 2*a*, 2*b* and 5. The strap 10 is provided with a central slot 11 having the dimensions of the body 21. In the case of a cylindrical body, the slot 11 of the strap is, naturally, circular with a diameter equal to that of the body 21.

The strap 10 is thus capable of being attached to the middle supporting element 20 by the introduction of said central slot 11 around the body 21 by flexible deformation at the passage of said gouged feature 22.

Owing to the obstacle to withdrawal presented by the gouged feature 22, the strap 10 is held in position in the middle supporting element 20 by the slot 11.

The interchangeability of the strap is provided by the possibility of the releasing, with a limited amount of force, of the strap 10 from the middle supporting element 20 in a movement that is the reverse of the one that has enabled the insertion of the strap into the middle supporting element.

The window 23 of the wrist watch of FIG. 1 is preferably made of sapphire. The bottom 24 of the middle supporting element 20 is a round screw-fitted bottom. The tightness of the watch is guaranteed up to 3×105 Pa (3 atm).

Figure 4B:
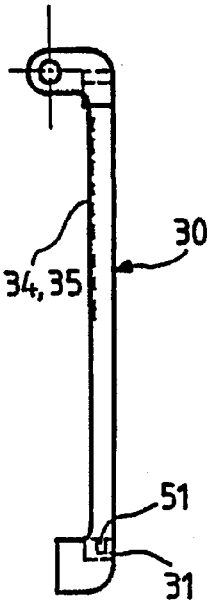
FIG. 4*b* is a side view of the frame of FIG. 4*a*.
Figure 4A:
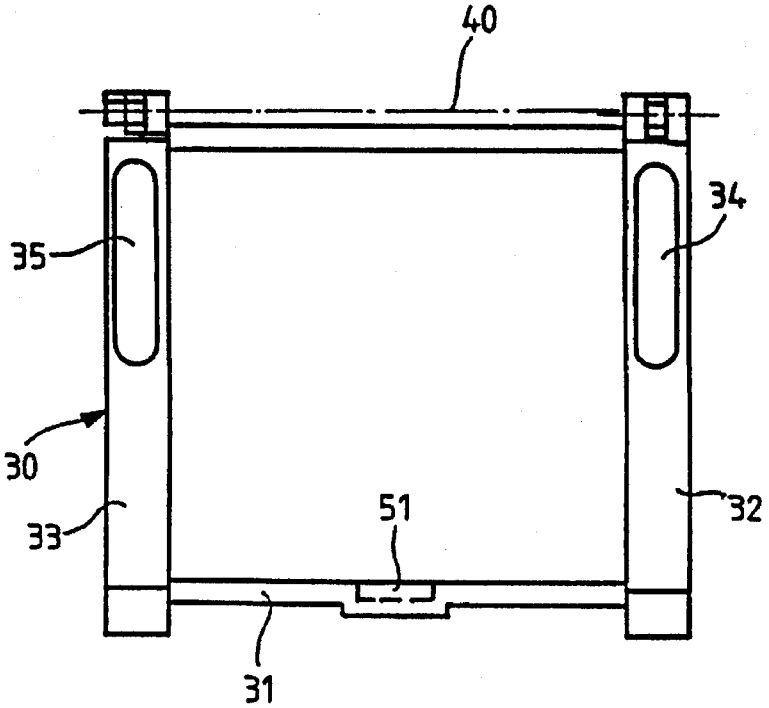
FIG. 4*a* is a bottom view of the cover-forming frame of the wrist watch of FIGS. 1, 2*a* and 2*b*.

FIGS. 1, 2*a*, 2*b* and 5 indicate that the wrist watch of the invention further has a cover 30 that can be folded down over the strap 10 which, in the proposed embodiment, is a frame shown in greater detail in FIGS. 4*a* and 4*b*, comprising a so-called closing stay 31, parallel to the axis of the strap 10, and two lateral stays 32, 33 perpendicular to the clasping stay 31 and connected to a hinge 40 made in the middle supporting element 20, about which the frame-cover 30 may perform a rotation of at least 90°.

The choice of a folding cover in the shape of a frame is in no way restrictive. It could equally well be solid for example. This folding cover, irrespective of its shape, makes it possible, firstly, to hold the strap 10 positively on the middle supporting element 20 and, secondly, to enhance the aesthetic quality of the watch. It may be made of steel, solid gold, gold and steel, or diamond-studded gold. Similarly, the strap may be made of copper, gold and steel or entirely gold.

The frame 30 and the middle supporting element 20 respectively comprise means to clasp the frame of the middle supporting element, constituted in the embodiment presented by a notch 51 made in the stay 31 for clasping the frame 30, working together with a catch-spring 52 positioned in the middle supporting element 20. The closing of the frame is therefore obtained very easily by simple pressure on the frame 30 so as the engage the catch-spring 52 elastically in the notch 51.

Figure 3:
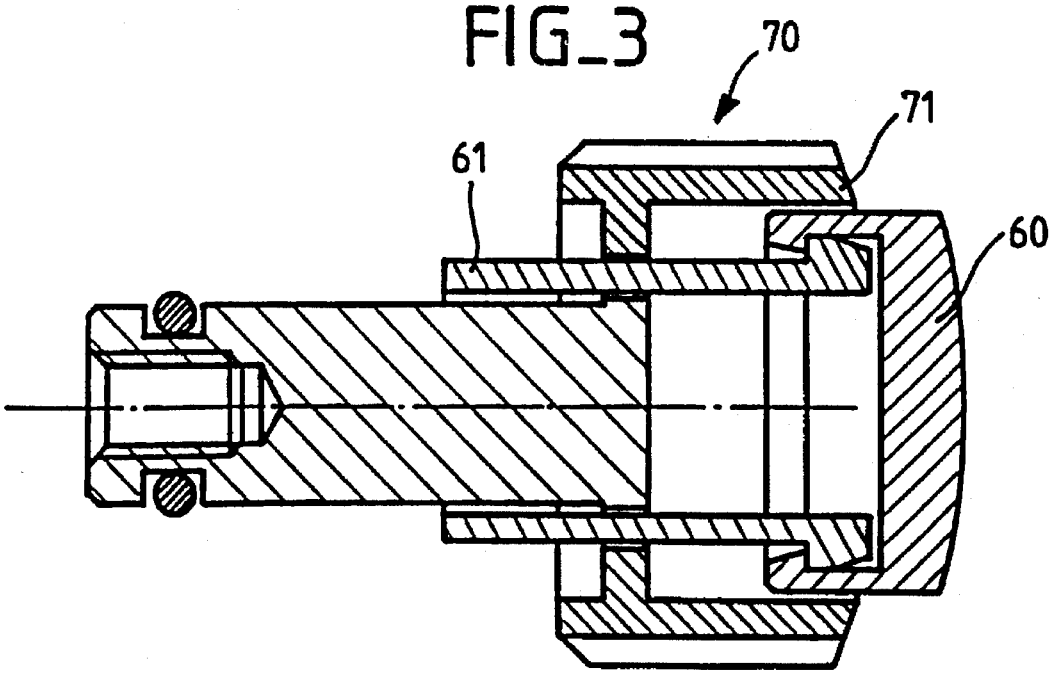
FIG. 3 is a sectional view of the winding mechanism of the wrist watch of FIG. 1.

Conversely, the opening of the frame 30 is done by the activation of opening means constituted, for example, by a button 60 of the catch-spring 52, integrated into the ring 71 of the winding mechanism 70 of the watch. As indicated by FIGS. 1 and 3, the button 60 drives a barrel 61 that gets applied to the catch-spring 52 in order to move this spring out of the notch 51, thus releasing the frame 30.

The opening of the frame can be facilitated by the presence, inside the lateral stays 32, 33 of the frame 30, of releasing leaf springs 34, 35.

Figure 2A:
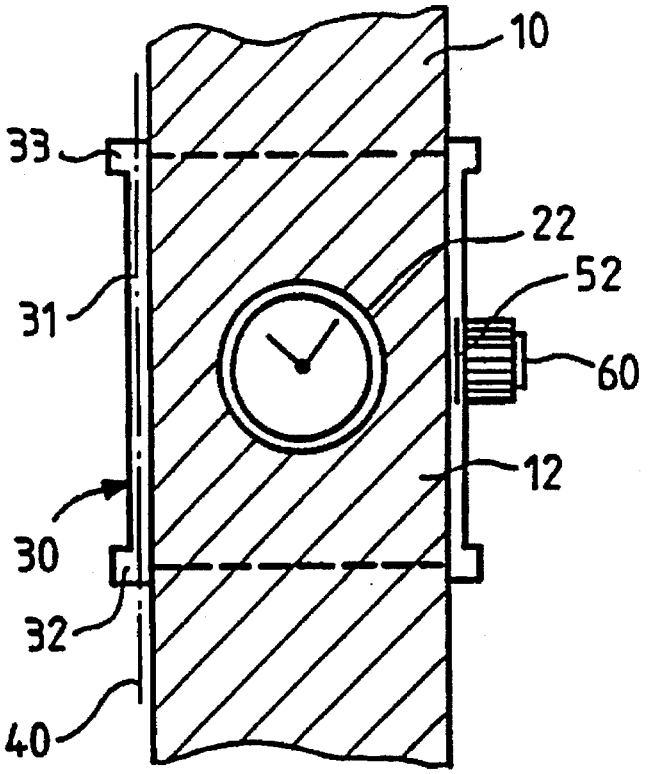
FIG. 2*a* is a top view of the wrist watch of FIG. 1, with the cover open.
Figure 2B:
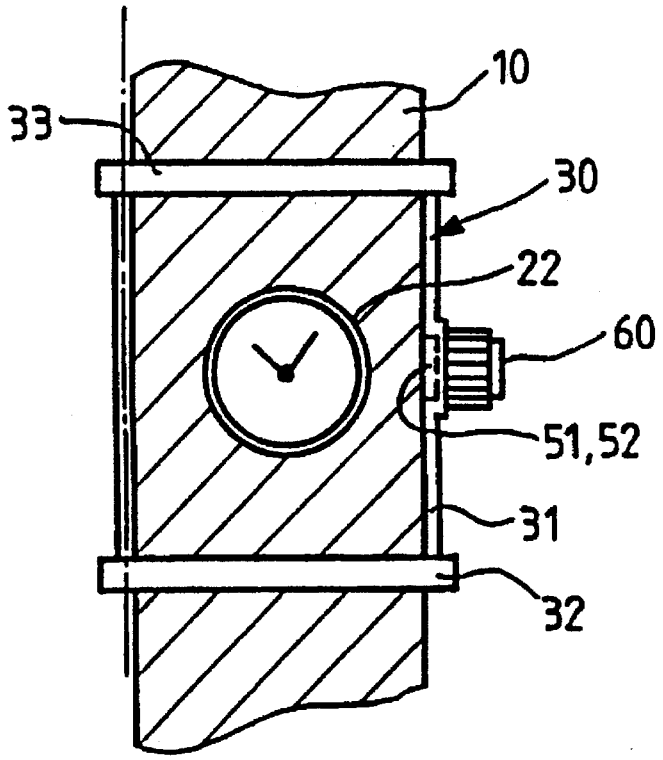
FIG. 2*b* is a top view of the wrist watch of FIG. 1, with the cover closed.

In order to limit the wear and tear on the strap 10 at the body and the cover, it is provided that the slot 11 will be made through a central stiffening web 12 made in the strap, and indicated by two lines of dashes in FIGS. 2*a* and 4. In particular, this central stiffening web is made of Kevlar (registered mark).

I claim:

1. A wrist watch comprising a supporting element (20), said supporting element including a body (21) and an interchangeable strap (10) forming a single unit, said strap having a central slot (11) adapted to be fitted about said body (21), the invention being characterized in that said wrist watch further comprises a hinged cover (30), a hinge (40) disposed on the supporting element (20) to permit said cover to be folded down on the strap (10) by rotation about said hinge (40), said cover (30) and said supporting element (20) having clasp means (51, 52) and opening means (60) on the supporting element (20) for releasing the clasp means and opening the cover.

2. A wrist watch according to claim 1, characterized in that the body (21) is surmounted by gouge means (22), said central slot (11) of the strap (10) adapted to be fitted about said body (21) by flexible deformation at the passage of said gouge means (22).

3. A wrist watch according to claim 1, characterized in that the slot (11) is disposed in a central stiffening web (12) in said strap (10).

4. A wrist watch according to claim 2, characterized in that the slot (11) is disposed in a central stiffening web (12) in said strap (10).

5. A wrist watch according to claim 3, characterized in that said central stiffening web (12) is made of Kevlar.

6. A wrist watch according to claim 4, characterized in that said central stiffening web (12) is made of Kevlar.

7. A wrist watch according to claim 1, characterized in that the clasp means comprises a notch (51) in the cover (30), and a operating catch-spring (52) positioned on the supporting element (20).

8. A wrist watch according to claim 7, characterized in that said opening means comprises a button (60) for activating said catch-spring (52).

9. A wrist watch according claim 8, characterized in that said button (60) is integrated with a ring (71) of a winding mechanism (70) of the watch.

10. A wrist watch according to claim 2, characterized in that the clasp means comprises a notch (50) in the cover (30) and a cooperating catch spring (52) positioned on the supporting element (20).

11. A wrist watch according to claim 3, characterized in the clasp means comprises a notch (50) in the cover (30) and a cooperating catch spring (52) positioned on the supporting element (20).

12. A wrist watch according to claim 5, characterized in that the clasp means comprises a notch (50) in the cover (30) and a cooperating catch spring (52) positioned on the supporting element (20).

13. A wrist watch according to claim 1, characterized in that the said cover (30) carries at least one spring (34, 35) for facilitating opening of said cover (30).

14. A wrist watch according to claim 2, characterized in that the said cover (30) carries at least one spring (34, 35) for facilitating the opening of said cover (30).

15. A wrist watch according to claim 3, characterized in that the cover (30) carries at least one spring (34, 35) for facilitating opening of said cover (30).

16. A wrist watch according to claim 5, characterized in that said cover (30) carries at least one spring (34, 35) for facilitating opening of said cover (30).

17. A wrist watch according to claim 7, characterized in that said cover (30) carries at least one spring (34, 35) for facilitating opening of said cover (30).

18. A wrist watch according to claim 8, characterized in that said cover (30) carries at least one spring (34, 35) for facilitating opening of said cover (30).

19. A wrist watch according to claim 8, characterized in that said cover (30) carries at least one spring (34, 35) for facilitating opening of said cover (30).

20. A wrist watch according to claim 7, characterized in that said cover is a frame (30) comprising a closing stay (31) bearing said notch (51), and two lateral stays (32, 33) linked to a hinge (40).

21. A wrist watch according to claim 13, characterized in that said lateral stays (32, 33) are each provided with a releasing leaf spring (34, 35).

22. A wrist watch according to claim 20, characterized in that said lateral stays (32, 33) are each provided with a releasing leaf spring (34, 35).

* * * * *